US007665502B2

(12) United States Patent
Dekker

(10) Patent No.: US 7,665,502 B2
(45) Date of Patent: Feb. 23, 2010

(54) ARCHITECTURAL COVERING

(75) Inventor: Nicolaas Dekker, Barendrecht (NL)

(73) Assignee: Hunter Douglas Industries BV, El Rotterdam (NL)

( * ) Notice: Subject to any disclaimer, the term of this patent is extended or adjusted under 35 U.S.C. 154(b) by 0 days.

(21) Appl. No.: 11/955,629

(22) Filed: Dec. 13, 2007

(65) Prior Publication Data

US 2008/0142169 A1 Jun. 19, 2008

(30) Foreign Application Priority Data

Dec. 14, 2006 (EP) ..... 06025940

(51) Int. Cl.
*E06B 9/36* (2006.01)
*E06B 9/303* (2006.01)

(52) U.S. Cl. ..... 160/168.1; 160/176.1 R

(58) Field of Classification Search ..... 160/176.1 R, 160/177 R, 178.1 R, 168.1 R, 170, 171, 173 R
See application file for complete search history.

(56) References Cited

U.S. PATENT DOCUMENTS

| | | | | |
|---|---|---|---|---|
| 2,028,696 | A * | 1/1936 | Beckwith | 251/129.03 |
| 4,020,889 | A * | 5/1977 | Karoll | 160/120 |
| 4,522,244 | A * | 6/1985 | Brolin | 160/170 |
| 4,687,041 | A | 8/1987 | Anderson | |
| 5,178,200 | A * | 1/1993 | Hagen | 160/107 |
| 5,390,721 | A * | 2/1995 | Oskam et al. | 160/168.1 V |
| 6,119,755 | A * | 9/2000 | Oskam | 160/84.02 |
| 6,474,393 | B1 * | 11/2002 | Welfonder | 160/168.1 V |
| 6,619,365 | B1 * | 9/2003 | Wen et al. | 160/168.1 P |
| 6,644,376 | B2 * | 11/2003 | Wielen | 160/170 |
| 2002/0069978 | A1 * | 6/2002 | van der Wielen | 160/176.1 R |
| 2003/0000654 | A1 * | 1/2003 | Welfonder | 160/168.1 P |
| 2004/0129821 | A1 * | 7/2004 | Priest et al. | 242/394 |
| 2004/0149399 | A1 * | 8/2004 | Colosio | 160/168.1 R |

FOREIGN PATENT DOCUMENTS

EP 1 213 438 A2 6/2002

* cited by examiner

*Primary Examiner*—Katherine W Mitchell
*Assistant Examiner*—Jaime F Cardenas-Garcia
(74) *Attorney, Agent, or Firm*—Dorsey & Whitney LLP

(57) ABSTRACT

A covering for an architectural opening includes a fixed stationary rail at one end of a plurality of slats and a movable rail at the opposite end of the slats with the slats being movable to and from the fixed rail to create extended and retracted positions of the architectural covering. At least one continuous drive cord is arranged in a loop with both its ends attached to the movable rail and at least one fixed cord return guide is provided. A drive spool adapted to be selectively rotatable in opposite directions of rotation and is operatively engaged with the drive cord so that the drive cord can be wrapped around the drive spool to establish driving engagement. An adjusting mechanism is provided for adjusting the plurality of slats and a drive shaft for rotatably driving the adjusting mechanism in opposite directions with the adjusting mechanism being adapted to rotatably engage the drive spool and wherein a lost-motion drive connection is operatively included between the adjusting mechanism and the drive spool.

6 Claims, 4 Drawing Sheets

ARCHITECTURAL COVERING

CROSS REFERENCE TO RELATED APPLICATION

This application claims priority to European Application No. 06025940.5, filed 14 Dec. 2006, and such application is hereby incorporated by reference as if fully disclosed herein.

BACKGROUND OF THE INVENTION

1. Field of the Invention

The invention relates to an architectural covering having a plurality of adjustable and retractable slats. In particular to an architectural covering that further includes a fixed stationary rail at one end of its plurality of slats, a movable rail at an opposite end of the plurality of slats, which is movable to and from the fixed rail to create extended and retracted positions of the architectural covering. In the operation of such blinds, in one form, raising and lowering of the movable rail is controlled by at least one continuous cord that is arranged in a closed loop with both its opposite ends attached to the movable rail.

2. Description of the Relevant Art

Such a retractable slatted covering is known from U.S. Pat. No. 4,687,041. In this window covering at least one fixed cord return guide is adapted to be stationary mounted in a plane extending through the fixed rail, the plurality of slats and the movable rail. The fixed cord return guide is positioned at a location spaced from the fixed rail and beyond the movable rail to an extent determined by a maximum extension required for the covering. In combination with pleated blinds it has been proposed to drive the movable rail by driving the looped continuous cord, as disclosed in U.S. Pat. No. 6,119,755. While usually the raising and lowering mechanisms of pleated blinds can be readily adapted to slatted venetian blinds, an inconvenience presents itself when it is attempted to use the raising and lowering drive also for tilting the slats. In such, so-called, mono-commando versions premature raising can occur while the slats are being tilted.

BRIEF SUMMARY OF THE INVENTION

Accordingly it is an object of the present invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

To this end the present invention provides an architectural covering having a plurality of adjustable and retractable slats, the architectural covering further includes: a fixed stationary rail at one end of the plurality of slats; a movable rail at an opposite end of the plurality of slats and movable to and from the fixed rail to create extended and retracted positions of the architectural covering; at least one continuous drive cord arranged in a closed loop with both its opposite ends attached to the movable rail; at least one fixed cord return guide adapted to being stationary mounted in a plane extending through the fixed rail, the plurality of slats and the movable rail, and in a location spaced from the fixed rail and beyond the movable rail to an extent determined by a maximum extension required for the covering; at least one drive spool adapted to be selectively rotatable in opposite directions of rotation, the at least one continuous drive cord being wrapped about the at least one rotary drive spool to establish a driving engagement, the at least one drive cord extends from the at least one rotary drive spool towards the movable rail, from there towards the at least one fixed cord return guide and back to the at least one rotary drive spool; an adjusting mechanism for adjusting the plurality of slats; and a drive shaft for rotatably driving the adjusting mechanism selectively in opposite directions, the adjusting mechanism being adapted to rotatably engage the drive spool, wherein a lost motion drive connection is operatively included between the adjusting mechanism and the at least one drive spool. The lost-motion between the tilt drive and the drive for raising and lowering inhibits any occurrences of raising or lowering during adjustments of the slat tilt angle.

Other advantageous variations will become apparent from the below description and from the appended dependant claims.

BRIEF DESCRIPTION OF THE DRAWINGS

The invention will now be described in reference to the appended drawing figures in which.

DESCRIPTION OF THE PREFERRED EMBODIMENTS

Figure 1:
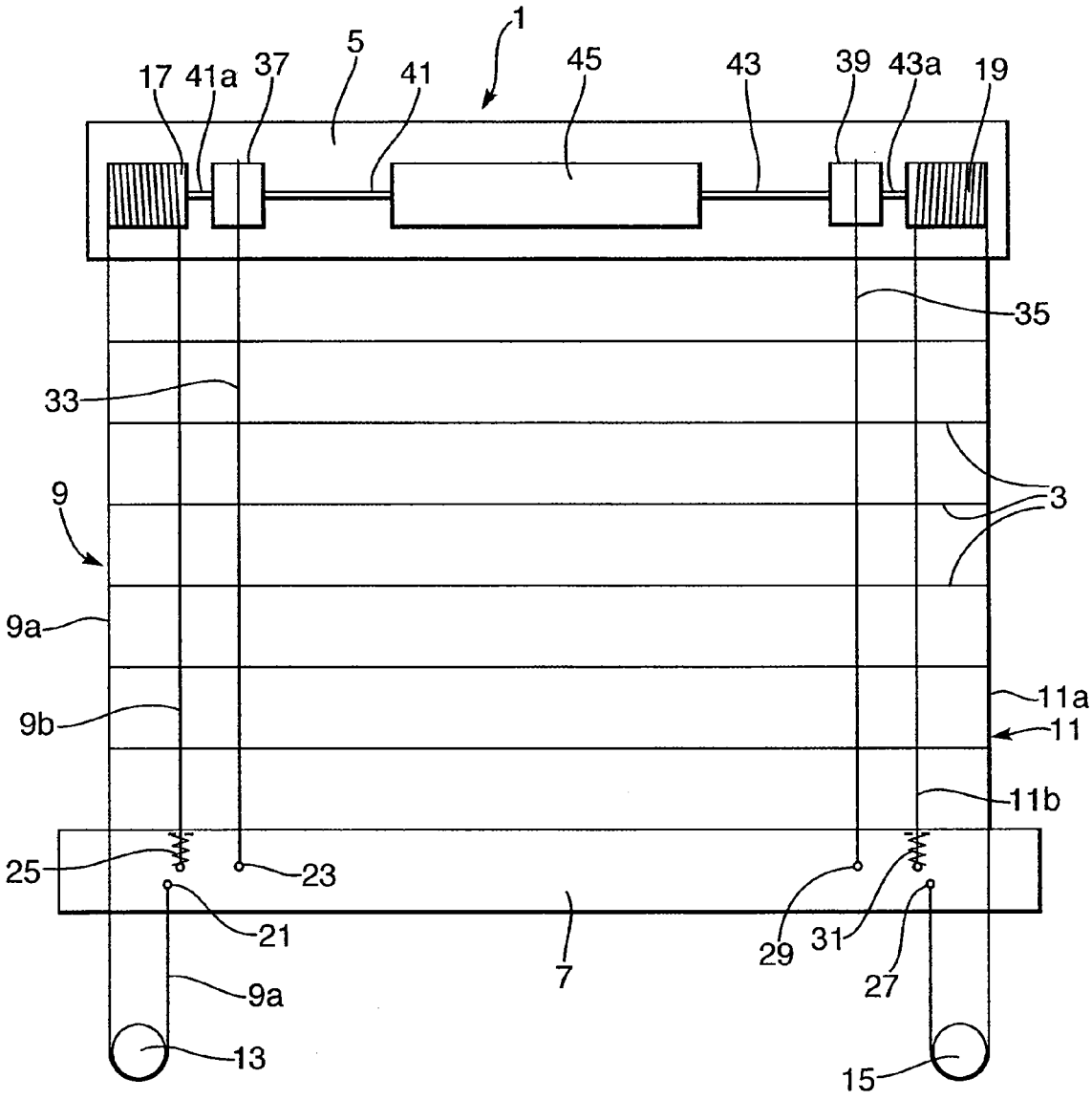
FIG. 1 shows schematically an architectural covering according to the invention.

Referring first to FIG. 1, there is shown an architectural covering 1 in the form of a slatted venetian type blind. The blind 1 includes a plurality of adjustable and retractable slats 3, bordered on an upper end by fixed stationary rail 5. A movable rail 7 is positioned at the lower and of the plurality of slats 3 and is parallel to the fixed rail 5. First and second continuous drive cords 9, 11 are arranged at opposite lateral edges of the architectural covering 1. Associated with each of the first and second drive cords 9, 11 is a respective first and second cord return guide 13, 15 which are each mounted in a stationary position remote from the fixed rail 5 and beyond the movable rail 7, to an extent determined by the maximum extension necessary for the architectural covering. Positioned at each lateral end of the headrail 5 are first and second drive spools 17, 19, each associated with a relevant one of the first and second drive cords 9, 11. The first and second drive spools 17, 19 are selectively rotatable in opposite directions of rotation and the drive cords are each wrapped about their respective drive spool a sufficient number of turns to provide a frictional driving engagement between the spool and the cord. First drive cord 9 being wrapped about the first drive spool 17 and one of its cord branches 9*a* extends to the first cord return guide 13 and then back to the movable rail 7, where it is attached at 21. Another cord branch 9*b* of the first drive cord 9 extends downwardly from the first drive spool 17 towards the movable rail 7. The other branch 9*b* is attached to the movable rail 7 at 23 by means of a tension spring 25. A similar arrangement, albeit in mirror image is adopted for the second drive cord 11, which has branches 11*a*, 11*b*, mounting points 27, 29 and tension spring 31. An adjusting mechanism for adjusting the angular position of the slats 3 is provided in the form of first and second ladder cords 33, 35 and respective first and second tilt pulleys 37, 39. Each of the first and second tilt pulleys 37, 39 is driven by a first and second drive shaft 41, 43 driven by electric motor 45. The first and second tilt pulleys 37, 39 each rotatably drive the respective first and second drive spool 17, 19 through lost-motion means that will be explained herein below. In FIG. 1 the drive from the tilt pulleys to the drive spools is merely represented by common drive shafts 41*a* and 43*a*.

Figure 2:
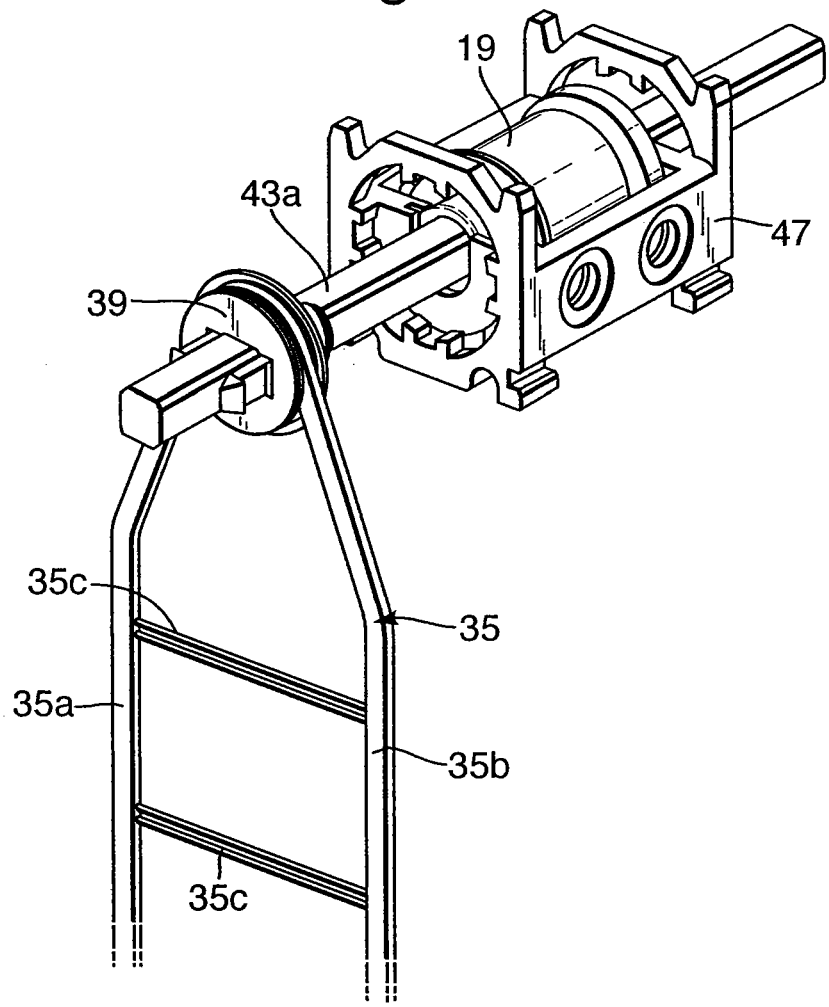
FIG. 2 is a perspective detail view of an adjusting mechanism, a drive spool and common drive shaft forming part of the present invention.

FIG. 2 is a perspective detail view of the second drive spool 19 together with the second tilt pulley 39 and the relevant portion of the common drive shaft 43*a*. The drive spool 19, schematically illustrated in FIG. 1, is shown in FIG. 2 to be supported in a bearing cradle 47, which is adapted to snugly fit in a headrail profile (not shown, but conventional). The second ladder cord 35 has side branches 35*a*, 35*b*, which are interconnected at a top end that is being engaged by the tilt pulley 39. In a conventional manner the ladder 35 is also provided with rungs 35*c*. The common drive shaft 43*a* has a square cross section and is non-rotatably received in a central square opening of the tilt pulley 39. Rotation of the shaft 43*a* will result in pivotal movement in the same sense of the cross rungs 35*c* and of the slats (not shown) resting thereon in a conventional manner. Once a fully tilted position of the slats has been obtained in one of two opposite directions the ladder cord 35 with its interconnected loop will slip about the pulley wheel 39 upon further rotation of the drive shaft. Such further rotation will then be useful to raise or lower the movable rail 7 (FIG. 1) by means of the action of the drive spool 19 on the drive cord 11.

Figure 3:
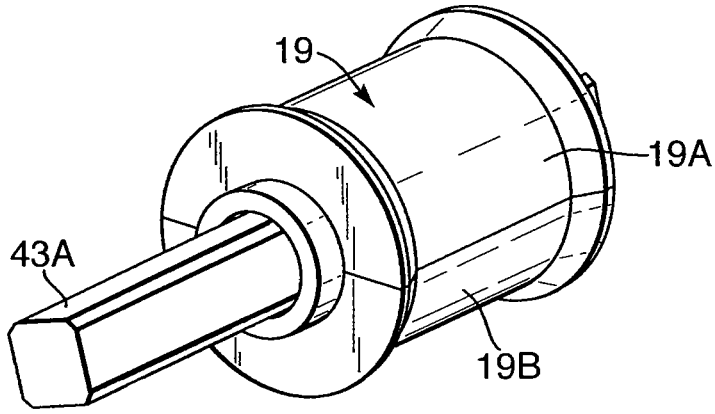
FIG. 3 is another perspective detail view of the drive spool and drive shaft of FIG. 2.

FIG. 3 in isolation shows the second drive spool on the common drive shaft 43*a*. The drive spool 19 comprises, preferably identical, drive spool halves 19*a*, 19*b*.

Figure 4:
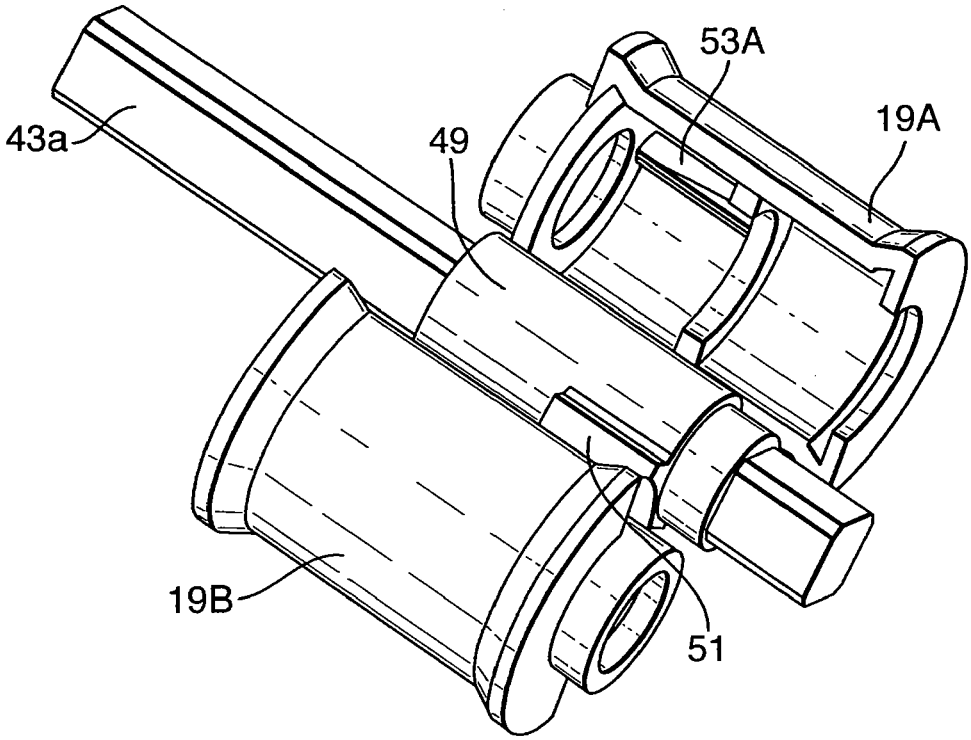
FIG. 4 is an exploded view of the detail assembly of FIG. 3.
Figure 5:
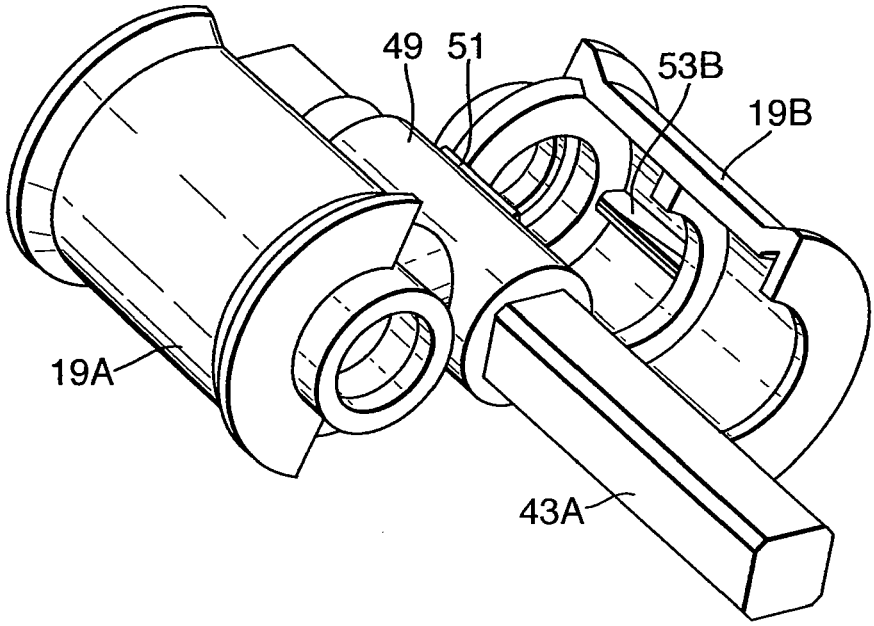
FIG. 5 is an exploded view of the detail assembly of FIG. 3, viewed from an opposite direction.

In FIGS. 4 and 5 exploded views are shown from opposite directions of the arrangement of FIG. 3. The square sectioned common drive shaft 43*a* carries a drive hub 49, which is mounted for rotation with the drive shaft 43*a*. The drive hub 49 has a radially extending cam 51 which engages an inner ridge 53*b* on drive spool halve 19*b* (visible in FIG. 5). Because the spool halves 19*a* and 19*b* are preferably, but not necessarily, identical the cam 51 on the drive hub 49 can engage the inner ridge 53*a* on spool halve 19*a* if the parts are inversely assembled. Accordingly the assembly of the components to obtain a drive spool 19 with internal lost motion engagement is not critical as to the orientation of the parts to be assembled and no particular attention or skill is required. It will be seen, that the cam 51 can engage the relevant inner ridge 53*a* or 53*b* on either side after almost a full revolution of the drive hub 49, before starting to rotate the drive spool 19. This will provide sufficient angular movement for the tilt pulley 39 to tilt the slats, before movement of the movable rail 7 starts to raise or lower the architectural covering.

Figure 6:
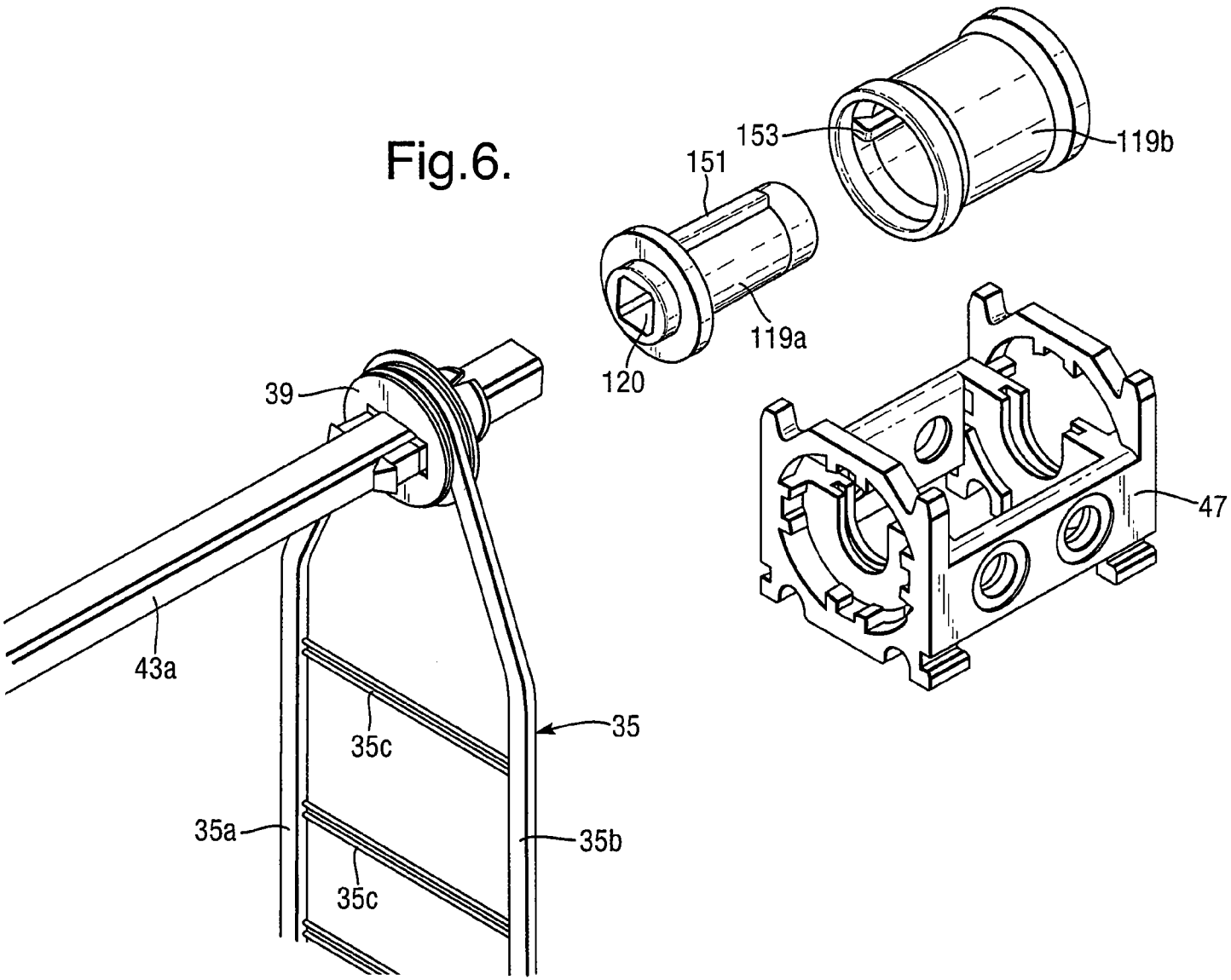
FIG. 6 is an exploded detail view of an alternative drive spool assembly.

FIG. 6, which corresponds largely to FIG. 2, shows an alternative embodiment of drive spool in an exploded arrangement. The second tilt pulley 39, the ladder cord 35, the common drive shaft 43*a* and the bearing cradle 47 are identical to those described in reference to FIG. 2. The different form of drive spool, in FIG. 6, includes an inner part 119*a* and an outer part 119*b*. The inner part 119*a* is non-rotatably engageable on the common drive shaft 43*a* by a square central bore 120 for rotation with the common drive shaft. The inner part 119*a* further carries a radially projecting can 151. The outer part 119*b* of the drive spool includes an inwardly directed ridge 153, which is adapted to be engaged on either of its opposite sides by the cam 151. The engagement of the ridge 153 by the cam 151 is separated by the major part of one revolution of the inner part 119*a*. In operation the common drive shaft 43*a* will tilt the ladder cord 35 upon every change in rotative direction. While the cam (51 or 151), driven by the common drive shaft 43*a*, can only engage the outer part 119*b*, the drive spool will only start raising the covering after the slats have been fully tilted. Such a lost-motion is particularly desirable for slatted coverings that are raised and lowered by a drive cord that is routed through an endless loop. It effectively prevents premature raising or premature tilting during the operation of such coverings.

While fairly conventional tilt drive pulleys 37 and 39 have been described with reference to FIGS. 1, 2 and 6, it should be understood that also more sophisticated tilt drive units might be used. One particularly suitable unit forms the subject of EP 1 213 438 (FIGS. 1 to 4) and the disclosure of that reference is hereby included for that purpose.

The skilled person will also understand that while an electric motor 45 is shown for driving the tilt drives 37, 39, this can be replaced by any suitable conventional manual drive means, such as a chain or crank drive.

It is thus believed that the operation and construction of the present invention will be apparent from the foregoing description and accompanying drawings. The invention is further not limited to any embodiment herein described and, within the purview of the skilled person, modifications are possible which should be considered within the scope of the appended claims. All kinematic inversions are to be equally considered within the scope of the present invention.

The term comprising when used in this description or the appended claims should not be construed in an exclusive or exhaustive sense but rather in an inclusive sense. Expressions such as: "means for . . . ". should be read as: "component configured for . . . " or "member constructed to . . . " and should be construed to include equivalents for the structures disclosed. The use of expressions like: "critical", "preferred", "especially preferred" etc., is not intended to limit the invention. Features, which are not specifically or explicitly described or claimed, may be additionally included in the structure according to the present invention without deviating from its scope.

Expressions, such as right, left, horizontal, vertical, above, below, upper, lower, top, bottom or the like if used in reference to the construction as illustrated in the accompanying drawings are relevant to the relative positions and in a different orientation of the construction should be interpreted in accordance with comparable relative positions.

The invention claimed is:

1. Architectural covering having a plurality of adjustable and retractable slats, the architectural covering further includes:

a fixed stationary rail at one end of the plurality of slats;

a movable rail at an opposite end of the plurality of slats and movable to and from the fixed rail to create extended and retracted positions of the architectural covering;

at least one drive cord attached to the movable rail;

at least one fixed cord return guide being stationary mounted in a plane extending through the fixed rail, the plurality of slats and the movable rail, and in a location spaced from the fixed rail and beyond the movable rail to an extent determined by a maximum extension required for the covering;

at least one drive spool for raising or lowering the covering having a hollow interior and being selectively rotatable in opposite directions of rotation, the at least one drive cord being wrapped about the at least one drive spool to establish a driving engagement, the at least one drive cord extending from the at least one drive spool around the at least one fixed cord return guide and back to its attachment to the movable rail before returning to the at least one drive spool;

an adjusting mechanism for adjusting the angle of said plurality of slats through a tilting movement;

a drive shaft for rotatably driving the adjusting mechanism selectively in opposite directions, the adjusting mechanism being adapted to rotatably drive the at least one drive spool, and a lost motion drive connection is-operatively included between the adjusting mechanism and the at least one drive spool, said lost motion drive connection including a radially inwardly directed ridge on said drive spool which operatively cooperates with a cam on said drive shaft such that only after said adjusting mechanism completes a tilting movement is the drive spool driven by the adjusting mechanism to raise or lower the covering.

2. Architectural covering according to claim 1, wherein the drive spool is located in the fixed rail.

3. Architectural covering according to claim 1, wherein the adjusting mechanism includes a pulley.

4. Architectural covering according to claim 1, wherein the adjusting mechanism is rotatably driven by an electric motor.

5. Architectural covering according to claim 1, wherein the at least one drive cord is paired with one further drive cord.

6. Architectural covering according to claim 1, wherein the at least one drive spool is rotatably supported in a bearing block.

* * * * *